US007600540B2

(12) United States Patent
Resendez et al.

(10) Patent No.: US 7,600,540 B2
(45) Date of Patent: Oct. 13, 2009

(54) STRETCHABLE STRAP WITH GRIPPER AND METHOD OF MAKING THE SAME

(75) Inventors: Pamela Resendez, Lafayette, CO (US); Abel Pereira, Seekonk, MA (US)

(73) Assignee: Textile Network, Inc., Lafayette, CO (US)

( * ) Notice: Subject to any disclaimer, the term of this patent is extended or adjusted under 35 U.S.C. 154(b) by 0 days.

(21) Appl. No.: 12/243,736

(22) Filed: Oct. 1, 2008

(65) Prior Publication Data

US 2009/0038706 A1 Feb. 12, 2009

Related U.S. Application Data

(62) Division of application No. 11/625,745, filed on Jan. 22, 2007, now Pat. No. 7,490,634.

(60) Provisional application No. 60/797,420, filed on May 3, 2006, provisional application No. 60/760,469, filed on Jan. 20, 2006.

(51) Int. Cl.

| | |
|---|---|
| ***D03D 15/08*** | (2006.01) |
| ***D03D 15/10*** | (2006.01) |
| ***D03D 15/04*** | (2006.01) |
| *D03D 15/00* | (2006.01) |
| *D03D 17/00* | (2006.01) |
| *D03D 11/00* | (2006.01) |

(52) U.S. Cl. ..... 139/421; 139/420 A; 139/422; 139/423; 139/426 R

(58) Field of Classification Search ..... None
See application file for complete search history.

(56) References Cited

U.S. PATENT DOCUMENTS

| | | | | |
|---|---|---|---|---|
| 3,629,871 | A * | 12/1971 | Sarmiento | 2/407 |
| 3,673,820 | A * | 7/1972 | Sarmiento | 66/177 |
| 3,710,599 | A * | 1/1973 | Sarmiento | 66/193 |
| 3,739,398 | A * | 6/1973 | Sarmiento | 2/407 |
| 3,948,702 | A * | 4/1976 | Theissen | 156/278 |
| 4,577,256 | A | 3/1986 | Breidegam | |
| 5,272,796 | A * | 12/1993 | Nichols | 24/712 |
| 5,436,044 | A | 7/1995 | Pinkos | |
| 5,632,526 | A | 5/1997 | McLarty, III et al. | |
| 5,749,400 | A * | 5/1998 | Pascual | 139/421 |
| 6,223,782 | B1 | 5/2001 | Watkins | |
| 6,446,677 | B1 | 9/2002 | Cheng | |
| 6,912,877 | B2 | 7/2005 | Yokoyama et al. | |
| 7,347,229 | B2 * | 3/2008 | Glenn et al. | 139/387 R |

(Continued)

OTHER PUBLICATIONS

Fabric & Fabric Weaves—A Primer, Heritage Shoppe, available at http://www.heritageshoppe.com/heritage/essays/fabric.html, printed Dec. 7, 2005, p. 1-6.

(Continued)

*Primary Examiner*—Bobby H Muromoto, Jr.
(74) *Attorney, Agent, or Firm*—Sheridan Ross P.C.

(57) ABSTRACT

A stretchable strap includes a side containing regions woven with frictionally enhancing material. Warp threads of both frictionally enhancing and non-frictionally enhancing material are woven to form a two-layer strap. Internal elastomeric threads provide a connection between the two layers as well as allow the strap to stretch. A method of making the strap is also provided wherein all elements are simultaneously woven on a loom.

12 Claims, 4 Drawing Sheets

U.S. PATENT DOCUMENTS

| | | | | |
|---|---|---|---|---|
| 7,490,634 | B2 | 2/2009 | Pereira et al. | |
| 2003/0111127 | A1* | 6/2003 | Kikuchi | 139/409 |
| 2003/0111128 | A1* | 6/2003 | Hannigan et al. | 139/421 |
| 2003/0159749 | A1* | 8/2003 | Hotta et al. | 139/421 |
| 2004/0214494 | A1* | 10/2004 | Murphy et al. | 442/149 |
| 2005/0076855 | A1* | 4/2005 | Throndsen et al. | 119/526 |
| 2006/0073751 | A1* | 4/2006 | Mol | 442/76 |
| 2006/0207296 | A1* | 9/2006 | Fujikawa | 66/202 |

OTHER PUBLICATIONS

Product Brochure, K&W Webbing Co., Inc., at least by Feb. 11, 2002, 10 pages.

Declaration of Abel Pereira under 37 CFR § 1.98, dated May 19, 2008, 11 pages.

* cited by examiner

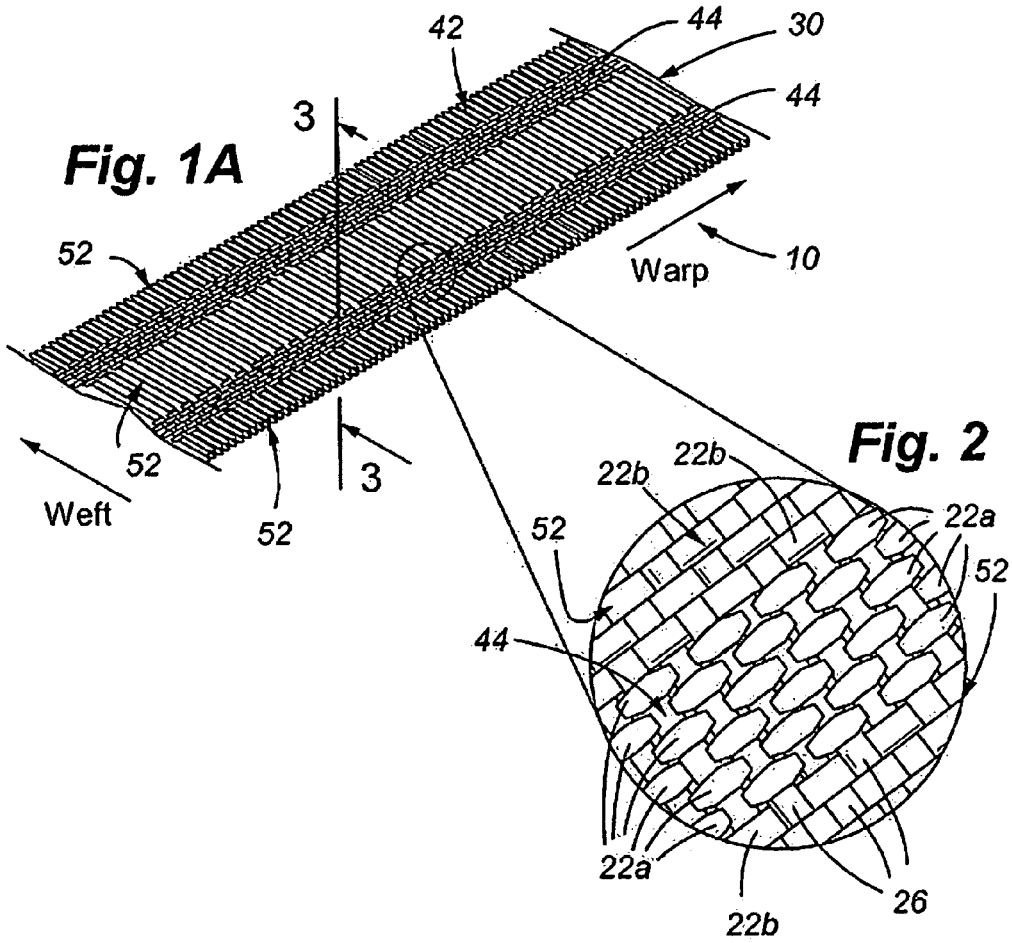
Fig. 1A
42
44
30
44
3
52
Warp
10
52
Weft
52
3
Fig. 2
22b
22b
22a
52
52
44
22a
22b
26
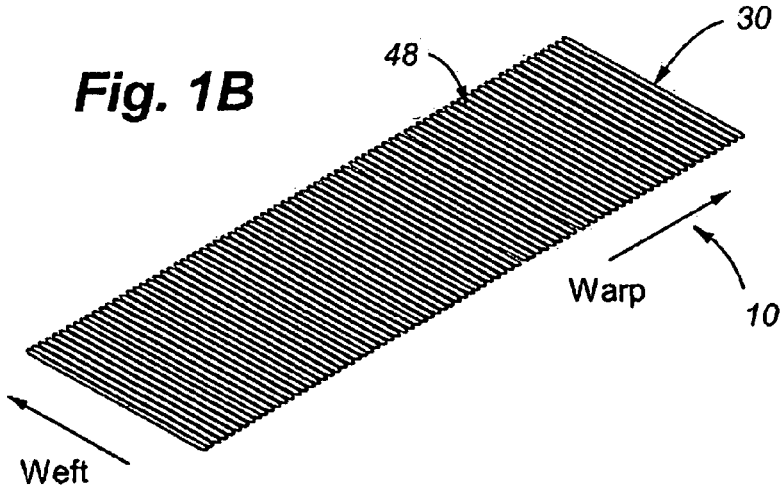
Fig. 1B
48
30
Warp
10
Weft Fig. 3
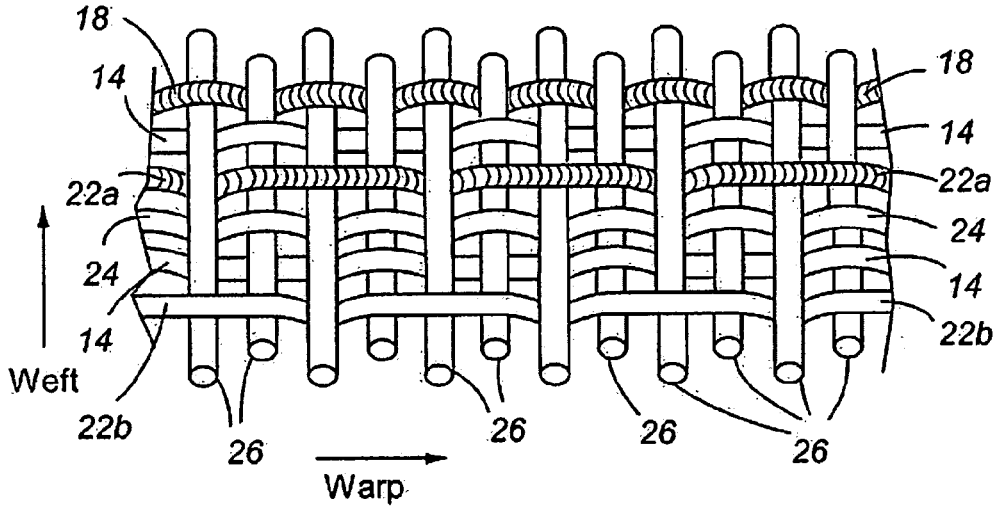
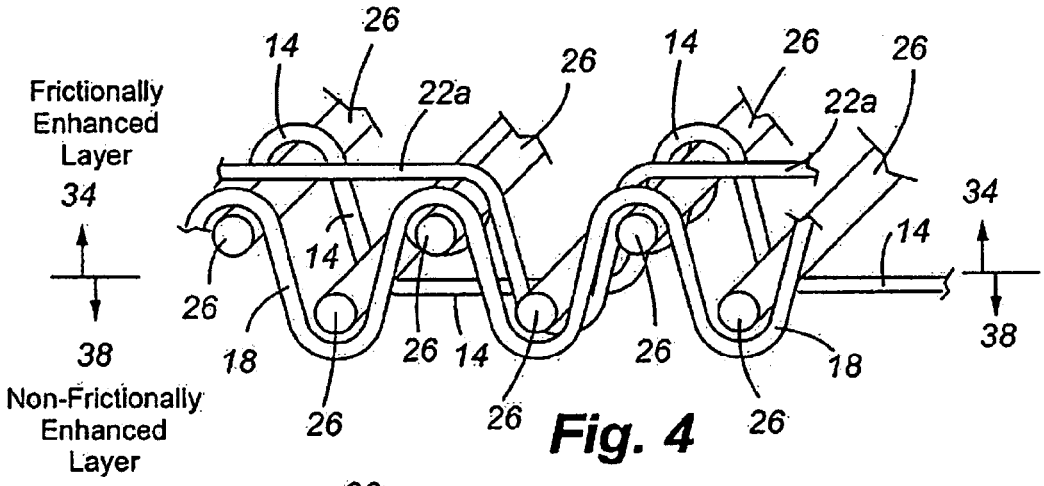
Fig. 4
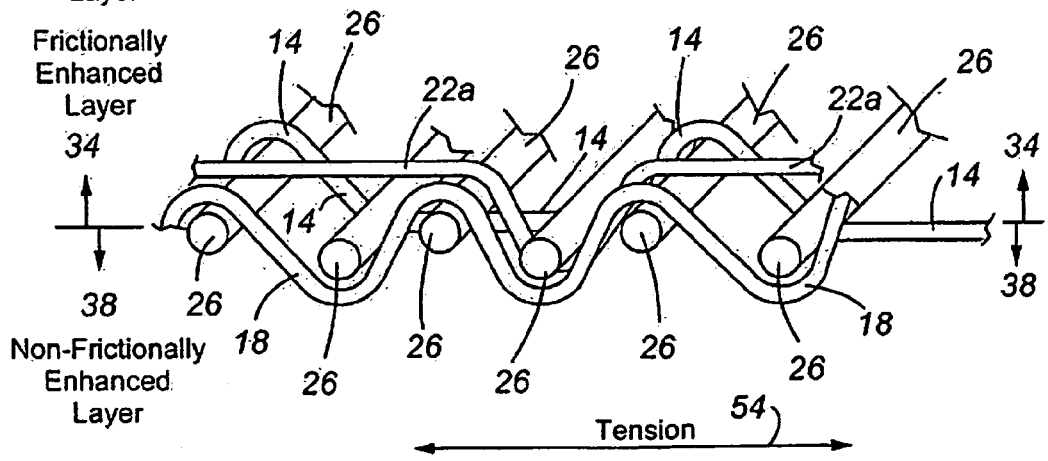
Fig. 5

STRETCHABLE STRAP WITH GRIPPER AND METHOD OF MAKING THE SAME

CROSS REFERENCE TO RELATED APPLICATIONS

The present application is a divisional application of U.S. patent application Ser. No. 11/625,745 filed Jan. 22, 2007, which claims the benefit of U.S. Provisional Patent Application No. 60/760,469 filed on Jan. 20, 2006, and also claims the benefit of U.S. Provisional Patent Application No. 60/797,420 filed on May 3, 2006. The contents of the above-referenced patent applications are incorporated herein by reference in their entirety.

FIELD OF THE INVENTION

The present invention generally relates to a strap, and more particularly, to a stretchable strap having a friction enhancing feature present along at least a first surface of the strap.

BACKGROUND OF THE INVENTION

Straps are used for a variety of purposes, including to hold or secure equipment in place, to allow attachment of an article to an object and/or a person's body, such as a backpack, gun-holster or tool-belt, and/or to allow a person to grip or otherwise carry a strap that is interconnected to an object, such as a duffle bag.

For many devices, it is desirable to utilize a strap to firmly secure equipment to a person's body. That is, certain objects are more easily carried and/or are more accurately maintained in position if the equipment is held in place. For example, a personal hydration system and/or backpack is more comfortable for some users if it does not move around excessively. However, tightening straps too tight to hold a backpack in place can also limit breathing and body motion. In addition, is it also advantageous to allow straps to accommodate movement of the human body, such as by providing straps that stretch. In the gun-holster example noted above, the holster's comfort and proper positioning would be improved if movement of a user's leg was accommodated by the strap when kneeling or bending down. In addition, it would be advantageous for the strap to maintain the position of the holster when the user is standing or moving. Thus, a strap is needed that accommodates movement of the user's body parts associated with the strap.

Some existing straps, such as an elastic strap, provide the ability to stretch when subjected to an applied tensile force. Other existing straps provide an external friction enhancing coating to prevent the items attached by means of the strap from slipping. However, the friction enhancing coatings tend to peel away with time. Thus, it would be desirable to have both of these elements incorporated into one strap, wherein the strap is capable of stretching and is durable. In addition, it would be desirable to have those elements that prevent slippage to retain their appearance and function when the strap is stretched.

Accordingly, to construct such a strap, appropriate materials are needed in an appropriate configuration to provide a strap with sufficient strength to support the weight of the equipment to which it is attached. Additionally, proper tensions for various threads, whether elastic or fabric, must be chosen such that the finished product has the desired appearance and performance.

SUMMARY OF THE INVENTION

The present invention comprises a stretchable strap that stretches in a first or longitudinal direction down the length of the strap, and further comprises a structure for enhancing the frictional characteristics of the strap. The strap has potential use in a variety of devices, including, but not limited to articles such as tool belts, harnesses, carrying devices, backpacks, luggage, carry-ons, bags, personal hydration systems, fanny/hip/waist packs, saddle-bags, lifting systems, lifting straps, connecting straps, binding straps and cargo straps. Another example of such use would be for securing a gun holster to the side of a user's thigh. It is to be understood, however, that the invention can be used for any purpose for which it is found applicable.

In accordance with embodiments of the present invention, a strap is provided for securing equipment to another object, including a person's body, wherein the strap both stretches and accommodates movement of the person's body and resists sliding along the body.

In accordance with one embodiment of the invention a strap is provided comprising:

- a frictionally enhanced layer comprising a plain weave woven from a plurality of upper warp threads and a first plurality of weft threads, the upper warp threads comprising frictionally enhanced threads and non-frictionally enhanced threads;
- a non-frictionally enhanced layer comprising a plain weave woven from a plurality lower warp threads and a second plurality of weft threads, the lower warp threads comprising non-frictionally enhanced threads; and
- a connection between the frictionally enhanced layer and the non-frictionally enhanced layer comprising a plurality of internally located elastomeric warp threads and a plurality of binder warp threads both woven over and under each of a complete set of weft threads, wherein every other warp thread of the connection belongs to the plurality of internally located elastomeric warp threads, and wherein the complete set of weft threads comprises the first plurality of weft threads and the second plurality of weft threads, wherein every other weft thread belongs to the first plurality of weft threads;
- wherein the strap may be stretched from a non-elongated state to an elongated state, and wherein in both the non-elongated state and the elongated state at least a portion of the plurality of frictionally enhanced upper warp threads remain:
  - i.) visible on a surface of the strap;
  - ii.) substantially coplanar with the surface; and
  - iii.) operable to provide friction enhancement along the surface.

In accordance with one embodiment of the invention a strap is provided wherein the frictionally enhanced threads comprise an elastomeric material.

In accordance with one embodiment of the invention a strap is provided wherein the elastomeric material comprises rubber.

In accordance with one embodiment of the invention a strap is provided wherein the elastomeric warp threads comprise rubber.

In accordance with one embodiment of the invention a strap is provided wherein the non-frictionally enhanced threads comprise at least one of polypropylene and nylon.

In accordance with one embodiment of the invention a strap is provided wherein the frictionally enhanced layer comprises:

one or more frictionally enhanced regions comprising sections of the frictionally enhanced layer woven with the frictionally-enhanced upper warp threads; and one or more non-frictionally enhanced regions comprising sections of the frictionally enhanced layer woven with the non-frictionally-enhanced upper warp threads;

wherein the one or more frictionally enhanced regions and the one or more non-frictionally enhanced regions are alternatingly disposed across a width of the strap.

In accordance with one embodiment of the invention a strap is provided wherein the frictionally enhanced layer comprises:

first and second frictionally enhanced regions comprising sections of the frictionally enhanced layer woven with the frictionally-enhanced upper warp threads; and first, second and third non-frictionally enhanced regions comprising sections of the frictionally enhanced layer woven with the non-frictionally-enhanced upper warp threads;

wherein the regions are disposed across a width of the strap in the following order:

the first non-frictionally enhanced region, the first frictionally enhanced region, the second non-frictionally enhanced region, the second frictionally enhanced region, and the third non-frictionally enhanced region.

In accordance with one embodiment of the invention a strap is provided wherein:

the first and second frictionally enhanced regions each contain six warp threads;

the first and third non-frictionally enhanced regions each contain three warp threads; and the second non-frictionally enhanced region contains sixteen warp threads.

In accordance with one embodiment of the invention a strap is provided wherein:

the first and second frictionally enhanced regions each contain eight warp threads;

the first and third non-frictionally enhanced regions each contain four warp threads; and the second non-frictionally enhanced region contains twenty warp threads.

In accordance with one embodiment of the invention a method for making a strap is provided, comprising:

weaving a frictionally enhanced layer in a plain weave from a plurality of upper warp threads and a first plurality of weft threads, the upper warp threads comprising frictionally enhanced threads under a first tension and non-frictionally enhanced threads under a second tension;

simultaneously weaving a non-frictionally enhanced layer in a plain weave from a plurality of lower warp threads and a second plurality of weft threads, the lower warp threads comprising non-frictionally enhanced threads under the second tension;

simultaneously weaving a connection between the frictionally enhanced layer and the non-frictionally enhanced layer by weaving a plurality of internal elastomeric warp threads under a third tension and a plurality of binder warp threads both woven over and under each of a complete set of weft threads, wherein every other warp thread of the connection belongs to the plurality of internally located elastomeric warp threads, and wherein the complete set of weft threads comprises the first plurality of weft threads and the second plurality of weft threads, wherein every other weft thread belongs to the first plurality of weft threads; and causing the first, second, and third tensions to relax after the weaving steps wherein:

i.) the plurality of internal elastomeric threads contracts causing the plurality of weft threads to draw together;

ii.) at least a portion of the plurality of frictionally enhanced upper warp threads remain visible on a surface of the strap, and substantially coplanar with the surface; and iii.) the plurality of frictionally enhanced upper warp threads remains operable to provide friction enhancement along the surface.

In accordance with one embodiment of the invention a method for making a strap is provided, wherein the frictionally enhanced threads comprise an elastomeric material and the non-frictionally enhanced threads comprise at least one of polypropylene and nylon.

In accordance with one embodiment of the invention a method for making a strap is provided, wherein the first tension is provided by one pound of weight placed on a mousetrap used to guide the frictionally enhanced upper warp threads;

the second tension is provided by a predetermined weight placed on a beam used to supply the fabric upper warp threads and the lower warp threads, wherein the predetermined weight is a predetermined fraction of a weight of the threads supplied on the beam; and the third tension is provided by a positive feed system associated with the loom.

In accordance with one embodiment of the invention a method for making a strap is provided, wherein the predetermined weight is decreased over time in proportion to a decrease in the supplied thread weight due to the weaving of the strap.

In accordance with one embodiment of the invention a method for making a strap is provided, wherein the step of weaving the frictionally enhanced layer further comprises:

weaving one or more frictionally enhanced regions with the frictionally-enhanced upper warp threads; and weaving one or more non-frictionally enhanced regions with the non-frictionally-enhanced upper warp threads;

wherein the frictionally and non-frictionally enhanced regions are alternatingly disposed across a width of the strap.

In accordance with one embodiment of the invention a method for making a strap is provided, wherein a plurality of frictionally and non-frictionally enhanced regions are alternatingly disposed across the width of the strap in the following order:

a first non-frictionally enhanced region, a first frictionally enhanced region, a second non-frictionally enhanced region, a second frictionally enhanced region, and a third non-frictionally enhanced region.

In accordance with one embodiment of the invention a method for making a strap is provided, wherein:

the first and second frictionally enhanced regions each contain six warp threads;

the first and third non-frictionally enhanced regions each contain three warp threads; and the second non-frictionally enhanced region contains sixteen warp threads.

In accordance with one embodiment of the invention a method for making a strap is provided, wherein:

the first and second frictionally enhanced regions each contain eight warp threads;

the first and third non-frictionally enhanced regions each contain four warp threads; and the second non-frictionally enhanced region contains twenty warp threads.

In accordance with one embodiment of the invention a strap is provided comprising:

a frictionally enhanced layer comprising a plain weave woven from a plurality of upper warp threads and a first plurality of weft threads, the upper warp threads comprising frictionally enhanced threads and non-frictionally enhanced thread;

a non-frictionally enhanced layer comprising a plain weave woven from a plurality lower warp threads and a second plurality of weft threads, the lower warp threads comprising non-frictionally enhanced threads; and a connection between the frictionally enhanced layer and the non-frictionally enhanced layer comprising a plurality of internal elastomeric warp threads and a plurality of binder warp threads both woven over and under each of a complete set of weft threads, wherein every other warp thread of the connection belongs to the plurality of internally located elastomeric warp threads, and wherein the plurality of internal elastomeric threads are located between the frictionally enhanced layer and the non-frictionally enhanced layer, and wherein the complete set of weft threads comprises the first plurality of weft threads and the second plurality of weft threads, wherein every other weft thread belongs to the first plurality of weft threads;

wherein the upper warp threads are arranged in frictionally enhanced regions and non-frictionally enhanced regions, the frictionally enhanced regions comprising a plurality of the frictionally enhanced upper warp threads, the non-frictionally enhanced regions comprising of plurality of the non-frictionally enhanced threads, wherein the frictionally and non-frictionally enhanced regions are alternatingly disposed across a width of the frictionally enhanced layer;

wherein the strap may be stretched from a non-elongated state to an elongated state, and wherein in both the non-elongated state and the elongated state at least a portion of the plurality of frictionally enhanced upper warp threads remain:

i.) visible on a surface of the strap;

ii.) substantially coplanar with the surface; and iii.) operable to provide friction enhancement along the surface.

In accordance with one embodiment of the invention a strap is provided wherein the disposition of the frictionally enhanced and non-frictionally enhanced regions are in the following order:

a first non-frictionally enhanced region, a first frictionally enhanced region, a second non-frictionally enhanced region, a second frictionally enhanced region, and a third non-frictionally enhanced region.

In accordance with one embodiment of the invention a strap is provided wherein the frictionally enhanced threads comprise an elastomeric material and the non-frictionally enhanced threads comprise at least one of polypropylene and nylon.

Various embodiments of the present invention are set forth in the attached figures and in the detailed description of the invention as provided herein and as embodied by the claims. It should be understood, however, that this Summary Of The Invention may not contain all of the aspects and embodiments of the present invention, is not meant to be limiting or restrictive in any manner, and that Invention as disclosed herein is and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

FIG. 1A is a perspective view of one embodiment of the present invention;

FIG. 1B is a perspective view of another embodiment of the present invention;

FIG. 2 is an enlarged top plan view of a portion of the device shown in FIG. 1A;

FIG. 3 is perspective view of a portion of the device shown in FIG. 2;

FIG. 4 is an enlarged perspective view of a portion of the device shown in FIG. 3;

FIG. 5 is an enlarged perspective view of a portion of the device shown in FIG. 3 under the application of an external tensile force;

Figure 6:
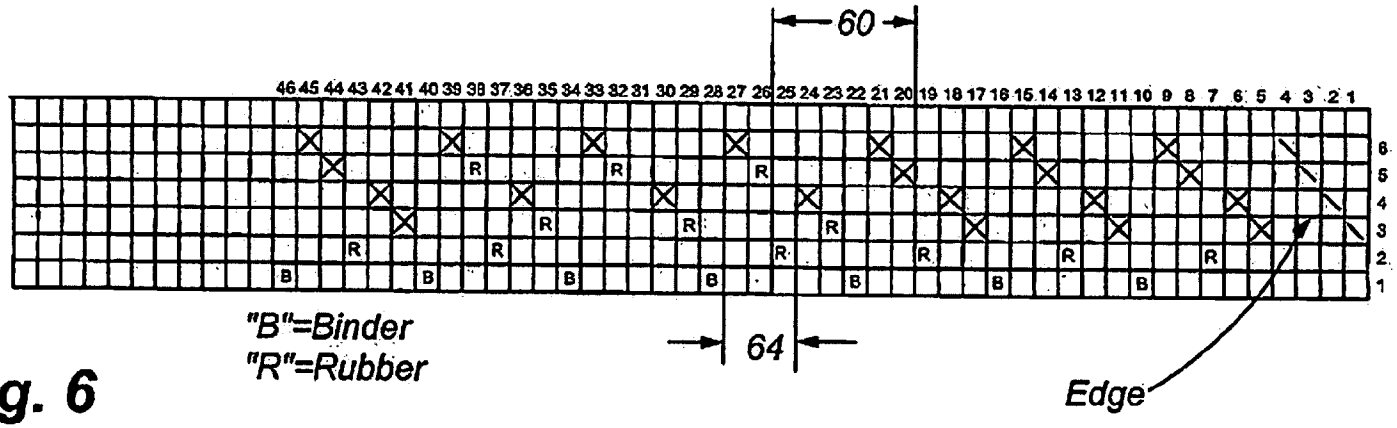
FIG. 6 is a draw in a reeding diagram for the manufacture of the device shown in FIG. 1A.

The drawings are not necessarily drawn to scale.

DETAILED DESCRIPTION

The present invention comprises a stretchable strap 10 with regions of a frictional enhancing component 44 exposed on one surface of the strap 10. The strap may be made in a variety of widths, such as widths between about 1 and 3 inches wide. Of course, the specific width may be customized for the particular device to which the strap is to be incorporated into. By way of example and not limitation, in one embodiment a strap having a total width of about 1.5 inches is provided. In a separate embodiment, a strap having a total width of about 2 inches is provided. In a separate embodiment, a strap having a total width of about 2.5 inches is provided.

The strap is woven such that it stretches in a longitudinal direction, and incorporates the frictional enhancing material by weaving rather than by gluing, such that the frictional enhancing material is integrally formed as part of the strap. In addition, the strap is woven such that it dose not elongate in a lateral direction.

Referring now to FIG. 1A, a perspective view of a stretchable strap constructed in accordance with an embodiment of the present invention is generally identified by the reference numeral 10. The stretchable strap 10 comprises a single panel of material 30; however, for purposes of understanding its construction, the stretchable strap 10 can be described as two woven layers 34 and 38 that are integrally formed as a single panel of material 30. In accordance with embodiments of the present invention, the frictional enhancing feature comprises a material that is frictionally distinguishable from the adjacent fabric. By way of example and not limitation, the strap 10 is preferably made of durable materials, such as nylon and rubber. However, it is to be understood that alternate materials may be used to form the strap 10, such as polypropylene for the fabric component, and such alternate materials are within scope of the present invention.

As illustrated in FIGS. 1A-7 and as used herein, "warp" refers to threads oriented in the longitudinal direction of the strap 10, and "weft" refers to threads directed laterally or across the width of the strap 10. The strap 10 generally comprises lower warp threads 14, upper warp threads 22, internal elastomeric warp threads 18, and binder warp threads 24, weft threads 26. The weaving process utilizes these materials to form a strap 10 that comprises a single panel 30, wherein the single panel 30 is comprised of two layers of material including a frictionally enhanced layer 34 and a non-frictionally enhanced layer 38. The upper warp threads 22 contain both elastomeric threads 22A and fabric threads 22B and are used to form the frictionally enhanced layer 34. The lower warp threads 14 contain only fabric threads and are used to form the non-frictionally enhanced layer 38.

Plain weaves, known in the art, are formed from weft and warp threads. Each warp thread is woven over one weft thread and under one weft thread. Adjacent warp threads alternate their position with respect to the weft. Specifically, when one warp thread is above the weft, adjacent warp threads are below the weft. In the present invention, two such plain weaves are formed from a single weft. A first plain weave is formed from the weft 26 and the upper warp threads 22, wherein this first plain weave corresponds to the frictionally enhanced layer 34. A second plain weave is formed from the weft 26 and the lower warp threads 14, wherein this second plain weave corresponds to the non-frictionally enhanced layer 38.

In accordance with a least one embodiment of the present invention, the upper warp threads 22 are woven such that each thread is over three weft threads and under one weft thread. The threads are staggered such that when an upper warp thread is below a weft thread, adjacent upper warp threads are above it. This forms the first plain weave with every other weft thread. This first plain comprises the frictionally enhanced layer 34. In a similar way, a second plain weave is formed from the weft threads not used to form the first plain weave and the lower warp threads 14. The lower warp threads 14 are woven such that each thread is under three weft threads and over one weft thread. The threads are staggered such that when a lower warp thread is above a weft thread, adjacent lower warp threads are below it. This forms a second plain weave with the weft threads unused by the first plain weave, and as noted above, this second plain weave comprises the non-frictionally enhanced layer 38.

The two plain weaves are woven together to form a single panel 30 by means of the internal elastomeric threads 18 and the binder threads 24. The elastomeric threads and binder threads are woven over and under each weft thread such that when an elastomeric thread is above a weft thread, the adjacent binder threads are below it.

Referring again to FIGS. 1A and 1B, the top surface 42 of the strap 10 is shown in FIG. 1A, and the bottom surface 48 of the strap is shown in FIG. 1B. In FIG. 1A, the upper warp threads 22 that comprise the frictionally enhanced layer 34 can be seen. In FIG. 1B, the lower warp threads 14 that comprise the non-frictionally enhanced layer 38 can be seen.

FIG. 1A shows an embodiment of the present invention wherein the frictionally enhanced layer 34, comprising the top surface 42 of the strap 10, is woven from two types of threads, namely upper warp threads 22A and 22B. In contrast, the non-frictionally enhanced layer 38, comprising the bottom surface 48 of the strap 10 and shown in FIG. 1B, is woven from a single type of thread, namely lower warp thread 14. In accordance with one embodiment of the present invention, the upper warp threads 22A are made from an elastomeric material such as rubber. The remaining warp threads, namely, the upper warp threads 22B and the lower warp threads 14, are made from a fabric such as nylon or polypropylene.

The use of elastomeric upper warp threads 22A to form part of the top surface 42 of the strap 10 provides friction-enhancing characteristics that accomplish one aspect of the invention. The exposed elastomeric material aids in allowing the strap 10 to secure attached devices with decreased movement because of the friction enhancing characteristics of the exposed elastomeric material acting on the adjacent surface. When the strap 10 is used to secure equipment to the human body, the elastomeric material 22A is placed in contact with the body (or garments associated therewith). Due to its higher coefficient of friction, the elastomeric material provides a means to prevent the strap 10 from slipping. As a result equipment secured by the strap is also prevented from slipping, and thus, the equipment is held firmly in place.

In the embodiment shown in FIG. 1A, the elastomeric upper warp threads 22A form two frictionally enhanced regions 44 of elastomeric material woven into the top surface 42 of the strap 10. Adjacent to the frictionally enhanced regions 44 are non-frictionally enhanced regions 52 woven from fabric upper warp threads 22B. The strap layout shown in FIG. 1A is but one example and is not meant to be limiting. Other configurations comprising different placements and widths for the frictionally enhanced regions are within the scope of the invention.

FIG. 2, a magnification of the invention shown in FIG. 1A, illustrates one frictionally-enhanced region 44 made from elastomeric upper warp threads 22A, and sections of two non-frictionally enhanced regions 38 adjacent to the frictionally enhanced region 44 and made from fabric upper warp threads 22B. In contrast to FIGS. 3-5, FIG. 2 depicts the appearance of the finished product. Consequently, the only warp threads visible in this view are those that comprise the frictionally enhanced layer 34, namely the upper warp threads 22. In addition, only half of the weft threads 26 are visible in FIG. 2. The warp and weft threads not visible in FIG. 2 comprise the non-frictionally enhanced layer 38 exposed on the bottom surface 48 of the strap 10.

As mentioned previously, while the upper warp threads 22 are woven over three weft threads and under one weft thread, the lower warp threads 18 are woven over one warp thread and under three warp threads. This woven structure is best seen in FIG. 3, wherein the strap is depicted at a greater magnification. Unlike FIG. 2, both the upper warp threads 22 and the lower warp threads 14 are visible. In addition, all of the weft threads are visible. Consequently, FIG. 3 is not intended to depict the strap 10 as it would appear after manufacturing, but rather, this figure depicts placement of threads for illustrative purposes only.

FIG. 3 includes both an elastomeric upper warp thread 22A and a fabric upper warp thread 22B. Consequently, FIG. 3 depicts an area of the strap 10 where the top surface 42 transitions between a non-frictionally enhanced region 52 and a frictionally enhanced region 44. Both upper warp threads 22A and 22B are shown woven in this over three weft threads and under one weft thread pattern. In addition, FIG. 3 depicts the over one weft thread and under three weft threads pattern of the lower warp threads 14.

Visible for the first time in FIG. 3 is an internal elastomeric warp thread 18 and a binder warp thread 24. In contrast to the upper and lower warp threads, these threads are woven over one weft thread and under one weft thread. This weaving pattern, depicted in FIG. 3, connects the frictionally enhanced layer 34, comprised of the upper warp threads 22, to the non-frictionally enhanced layer 38, comprised of the lower warp threads 14. This connection between the two layers provided by the internal elastomeric warp threads 18 and binder threads 24 allows the strap 10 to function as a single panel 30.

Due to its elastic properties, this elastomeric material allows the strap 10 to stretch in the longitudinal direction. This ability to stretch accomplishes a second aspect of the invention. That is, in addition to fixedly securing equipment to the human body, the strap is able to stretch in order to accommodate movement of the human body, and the internal elastomeric threads 18 aid in providing this characteristic to the strap 10.

An understanding of how this ability to stretch is accomplished can be had by an inspection of FIG. 4. Therein, one internal elastomeric warp thread 18, one upper warp thread 22, and one lower warp thread 14 are depicted. During the manufacture of the strap 10, these and other threads are woven on a loom under various tensions. More particularly, the ability of the strap 10 to stretch is associated with the tension applied on the internal elastomeric threads 18, during manufacture of the strap 10. Subsequent to removing the strap 10 from the loom, this tension relaxes, causing the internal elastomeric threads 18 to contract. This contraction causes the weft threads 26 to be drawn together, and in turn, this drawing together causes the length of the strap 10 to decrease. This aspect of the invention is shown, exaggerated for illustrative purposes, in FIG. 4.

In FIG. 5, the section of the strap 10 depicted in FIG. 4 is shown under the application of a tensile force 54 in the longitudinal direction. Here, a fraction of the tension present when the strap was on the loom is restored. As a result, the weft threads 26 draw apart and the strap 10 elongates. Such a longitudinal tensile force results from movement of the body or device to which the strap 10 is affixed.

Turning now to the method for making the stretchable strap 10, which is preferably manufactured on a Muller Loom Serial No. MBT. In accordance with at least one embodiment of the present invention, the method of making of making the strap 10 comprises weaving the various elements of the strap 10 discussed above simultaneously on a loom. While the above discussion described layers of the strap and connections between these layers, it should be understood that these elements are not separately assembled and connected during the manufacture of the strap 10. In particular, the strap 10 is not manufactured by first forming a woven tube and then weaving the tube closed to form a single panel. All the treads woven in the warp direction are simultaneously draw into the loom and woven together.

Figure 7:
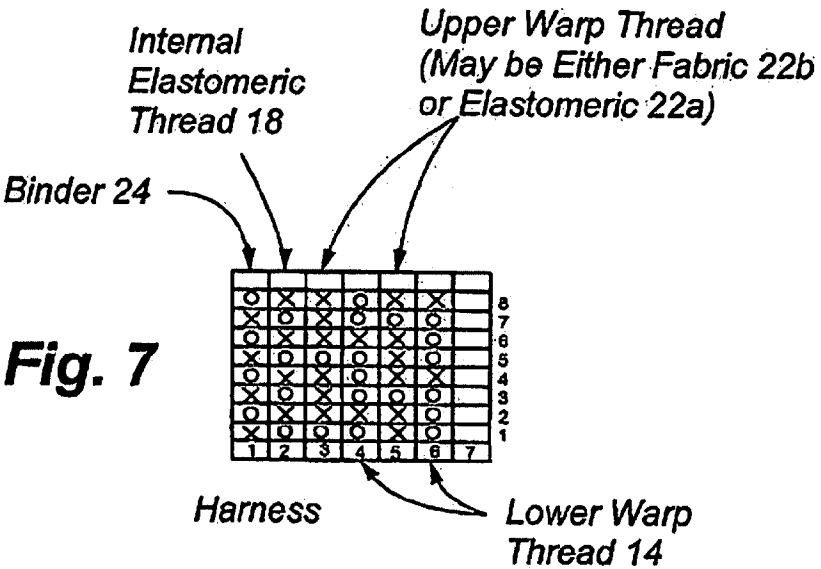
FIG. 7 is a chain and harness diagram for the manufacture of the device shown in FIG. 1A.

In accordance with at least one embodiment of the present invention, six harnesses are used to govern the positions of the threads as they are draw into the loom. FIGS. 6 and 7 contain charts detailing the specific operation on the loom during the manufacture of the inventive strap 10.

FIG. 6 contains a "Draw In and Reeding" diagram that can be understood in conjunction with the "Harness" diagram of FIG. 7. FIG. 6 reads from right to left and diagrams the placement of warp threads 14 and 22, internal elastomeric warp threads 18, and binder warp threads 24 across a width of the strap. An "X" represents a fabric warp thread. An "R" represents a elastomeric thread. A "B" represents a binder thread. The reeding begins with the four "\" symbols at the extreme right end of the diagram in Columns 1-4. This corresponds to four warp threads that are not woven into the weft and are used to form the edge of the strap. Beginning at Column 5 and progressing to the left, the placement of threads woven into the weft is diagrammed. Threads appearing in the same row of FIG. 6 are placed on the same harness. For example, the binder threads appearing in Columns 10, 16, 22, 28, 34, 40, and 46 of FIG. 6 are located on Harness 1. The operation of Harness 1 is depicted in Column 1 of FIG. 7, as further described below.

As noted above, in one embodiment of the invention, six total harnesses are used to manufacture the inventive strap 10. The operation of the six harnesses is diagrammed in FIG. 7, wherein columns correspond to harnesses. An "O" refers to the harness being in a down position. An "X" refers to the harness being in an up position. By way of example, the position diagramed in Row 1 of FIG. 7 indicates that the Harnesses 1 and 5 are in an up position and Harnesses 2, 3, 4, and 6 are in a down position.

FIG. 7. diagrams successive positions of the six harness over the course of the weaving process. Rows 1-8 diagram two cycles of a pattern that is continually repeated throughout the production of a given length of the inventive strap 10. Continuing with the above example, the transition between the harness positions depicted in Row 1 and the harness positions depicted in Row 2 takes place as follows. Harness 1 changes from an up to a down position. Harnesses 2, 3, and 4 change from a down to an up position. Harness 5 remains in an up position. Harness 6 remains in a down position. Thus, FIG. 7 thus depicts a pattern of successive positions for the six harnesses. This pattern begins to repeat at Row 5, wherein the original position of Row 1 is again attained.

By way of further example, consider Harness 3 whose successive positions are depicted in Column 3 of FIG. 7, and which moves the threads contained in Row 3 of FIG. 6. As can be seen from FIG. 6, both fabric warp threads and elastomeric warp threads are placed on Harness 3. As can be seen from FIG. 7, Harness 3 moves in a down one, up three pattern. As can be appreciated from the previous discussion regarding the structure of the inventive strap 10, Harness 3 contains upper warp threads 22. The threads appearing at columns 5, 11, 17, and 41 of FIG. 6 are upper warp threads 22B. The threads appearing columns 23, 29, and 35 of FIG. 6 are elastomeric upper warp threads 22A. Similarly, the six harnesses contain the various threads of the inventive strap 10 as follows: Harness 1 contains the binder threads 24; Harness 2 contains the internal elastomeric threads 18; Harnesses 3 and 5 contain the upper warp threads 22, including both elastomeric 22A and fabric 22B; and Harnesses 4 and 6 contain the lower warp threads 14.

Referring again to FIG. 6, the placement of threads is depicted for a particular width of the inventive strap. As now can be appreciated, this placement begins at an edge and continues inward for a width that compasses one non-frictionally enhanced region 52, one frictionally enhanced region 44, and the beginning of a second non-frictionally enhanced region 52. Section 60, encompassing Columns 20-25, contains the transition between a non-frictionally enhanced region 52 and a frictionally enhanced region 44. This section corresponds to the area of the inventive strap depicted in FIG. 3. Section 64, encompassing Columns 25-27, corresponds to the area of the inventive strap depicted in FIGS. 4 and 5.

During the weaving process to form the strap 10, the internal and external elastomeric threads 18 and 22A, respectively, are drawn into the loom under different tensions. The elastomeric upper warp threads 22A, comprising the frictionally enhanced regions 44 on the top surface 42 of the strap 10, are under a lighter tension than the internal elastomeric threads 18. The internal elastomeric threads 18, used in part to hold the two layers 34 and 38 together, is woven under a greater tension and cannot be seen when viewing the exterior of the strap 10. The internal elastomeric threads 18 also allow for elongation of the strap 10 upon application of an external tensile force 54. In addition, the fabric threads, including the non-frictionally enhanced upper warp threads 22B and the lower warp threads 14 are drawn into the loom under a still different tension.

In accordance with embodiments of the present invention, the tensions applied these threads during the manufacturing process are chosen to ensure proper appearance and performance of the finished strap. As noted above, the strap is woven on a loom using fabric threads (such as nylon or polypropylene), elastomeric threads (such as rubber), and binder and weft threads of a suitable material. As described further below, various tensions are imparted to these threads as they are drawn into the loom.

Figure 8:
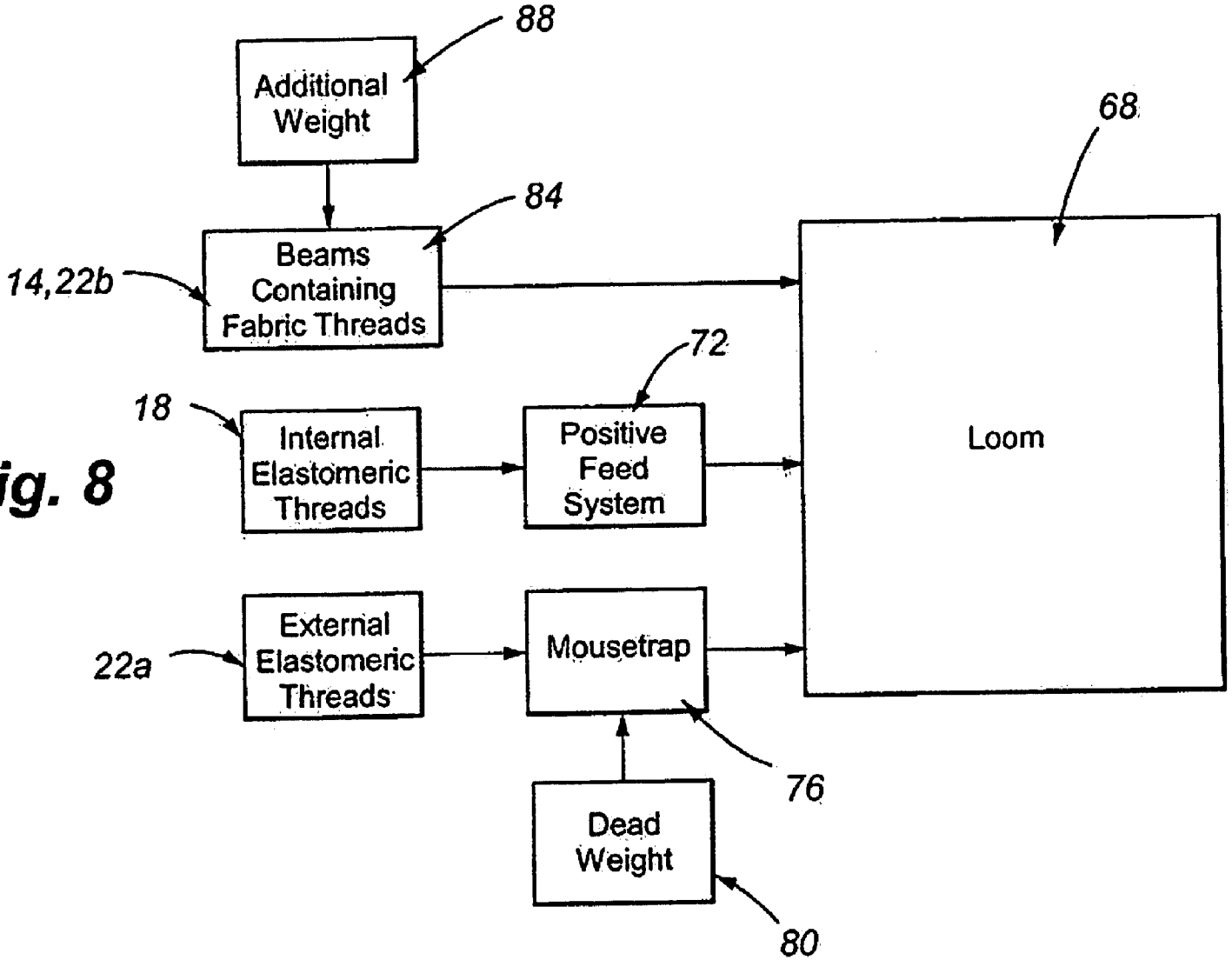
FIG. 8 is a schematic depiction of components that may be included in the method of making the strap in accordance with embodiments of the present invention.

In accordance with at least on embodiment of the present invention, the method in which the various threads are drawn into the loom is diagrammed in FIG. 8. In addition, FIG. 8 diagrams how tension is provided on these threads. The tensions given herein are used in conjunction with a Muller Loom Serial No. MBT. Three separate processes are used to drawn in the elastomeric upper warp threads 22A, and the fabric warp threads 14 and 22B, and the internal elastomeric threads 18.

The elastomeric upper warp threads 22A are fed into the loom 68 by means of a mousetrap 76. A dead weight 80 is used to provide the tension on the elastomeric upper warp threads 22A. The dead weight 80 is hung from the mousetrap 76. The tension placed on the external elastomeric threads 22A is chosen such that the elastomeric material functions properly to provide friction enhancement. More particularly, too much tension will cause the elastomeric threads 22A to become woven too tightly with the fabric, thereby pulling the elastomeric threads down into the fabric matrix. This will cause the elastomeric material to lose both its appearance and its ability to frictionally enhance the strap. In contrast to too much tension, too little tension will cause the elastomeric threads 22A to rise above the surface of the strap, where they can become entangled with other objects. In accordance with at least one embodiment of the present invention, one pound of dead weight 80 in addition to the tension caused by the weight of the mousetrap 76 is needed to provide the appropriate tension on the elastomeric upper warp threads 22A. This weight is hung from the mousetrap 76 as shown in FIG. 8. This provides the elastomeric upper warp threads 22A with a relatively lighter tension in comparison with the other warp threads.

In accordance with at least one embodiment of the present invention a process is used to feed in and provide tension for the fabric threads, including both the fabric upper warp threads 22B and the lower warp threads 14. These threads are supplied on beams 84 and feed directly into the loom 68. Additional weight 88 is hung from the beams 84 containing the fabric threads to provide tension on these threads. These fabric threads include both the fabric upper warp threads 22B and the lower warp threads 14. During a particular production run, as time passes and greater lengths of the strap 10 are produced, less martial and thus less weight is on the beams 84 because thread has been used thereby reducing the weight on the beams 84. Consequently, it is necessary to compensate for this reduced weight by gradually decreasing the additional weight 88 used to supply tension. The weight is removed from additional weight 88 in proportion to the amount of weight lost due to the fabric being feed into the machine. For example, in accordance with at least one embodiment of the present invention, it is found that ten to twelve pounds of additional weight is need to provide the appropriate tension for one hundred pounds of fabric thread. When half of the fabric has been removed, half of the additional weight should be removed. Thus, when fifty pounds of fabric remain on the beam, five to six pounds of additional weight should be hung from the beam 84.

In accordance with at least one embodiment of the present invention, a positive feed system is used to provide tension on the internal elastomeric threads 18. This allows these threads to be woven under a greater tension than both the fabric threads 14 and 22B and the elastomeric upper warp threads 22A. This greater tension is needed to provide the strap 10 with an ability to stretch. As described above, this tension will relax subsequent to removing the strap 10 from the loom 68, thereby causing weft threads 26 to draw together. Later, when an external tensile force 54 is applied to the strap 10, an elongation is achieved when the weft threads 26 are drawn apart. The internal elastomeric threads 18 are fed through a positive feed system 72 and then into the loom 68. This enables the manufacturer of the strap 10 to control the tension on the internal elastomeric threads 18. The tension placed on the interior elastomeric threads 18 is chosen such that the strap is provided with an ability to stretch.

The following U.S. Patents are incorporated by reference in their entirety: U.S. Pat. Nos. 6,912,877; 4,577,256; 5,632,526; 6,223,782; 5,436,044; and, 6,446,677.

To assist in the understanding of the present invention the following list of components and associated numbering found in the drawings is provided herein:

10 Stretchable Strap
14 Lower Warp Threads
18 Internal Elastomeric Threads
22 Upper Warp Threads
22A Elastomeric Upper Warp Threads
22B Fabric Upper Warp Threads
23 Binder Threads
26 Weft Threads
30 Single Panel of Stretchable Strap
34 Frictionally Enhanced Layer
38 Non-Frictionally Enhanced Layer
42 Top Surface of Stretchable Strap
44 Frictionally Enhanced Region
48 Bottom Surface of Stretchable Strap
52 Non-Frictionally Enhanced Region
54 Externally Applied Tensile Force
60 Section FIG. 6 Corresponding to FIG. 3
64 Section FIG. 6 Corresponding to FIGS. 4&5
68 Loom
72 Positive Feed System
76 Mousetrap
80 Dead Weight
84 Beam
88 Additional Beam Weight The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit Invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A strap, comprising:

a frictionally enhanced layer comprising a plain weave woven from a plurality of upper warp threads and a first plurality of weft threads, said upper warp threads comprising frictionally enhanced threads and non-frictionally enhanced threads;

a non-frictionally enhanced layer comprising a plain weave woven from a plurality lower warp threads and a second plurality of weft threads, said lower warp threads comprising non-frictionally enhanced threads; and a connection between said frictionally enhanced layer and said non-frictionally enhanced layer comprising a plurality of internally located elastomeric warp threads and a plurality of binder warp threads both woven over and under each of a complete set of weft threads, wherein every other warp thread of said connection belongs to said plurality of internally located elastomeric warp threads, and wherein said complete set of weft threads comprises said first plurality of weft threads and said second plurality of weft threads, wherein every other weft thread belongs to said first plurality of weft threads;

wherein said strap may be stretched from a non-elongated state to an elongated state, and wherein in both said non-elongated state and said elongated state at least a portion of said plurality of frictionally enhanced upper warp threads remain:

i.) visible on a surface of said strap;

ii.) substantially coplanar with said surface; and iii.) operable to provide friction enhancement along said surface.

2. The strap according to claim 1, wherein said frictionally enhanced threads comprise an elastomeric material.

3. The strap according to claim 2, wherein said elastomeric material comprises rubber.

4. The strap according to claim 1, wherein said elastomeric warp threads comprise rubber.

5. The strap according to claim 1, wherein said non-frictionally enhanced threads comprise at least one of polypropylene and nylon.

6. The strap according to claim 1, wherein said frictionally enhanced layer comprises:

one or more frictionally enhanced regions comprising sections of said frictionally enhanced layer woven with said frictionally-enhanced upper warp threads; and one or more non-frictionally enhanced regions comprising sections of said frictionally enhanced layer woven with said non-frictionally-enhanced upper warp threads;

wherein said one or more frictionally enhanced regions and said one or more non-frictionally enhanced regions are alternatingly disposed across a width of said strap.

7. The strap according to claim 1, wherein said frictionally enhanced layer comprises:

first and second frictionally enhanced regions comprising sections of said frictionally enhanced layer woven with said frictionally-enhanced upper warp threads; and first, second and third non-frictionally enhanced regions comprising sections of said frictionally enhanced layer woven with said non-frictionally-enhanced upper warp threads;

wherein said regions are disposed across a width of said strap in the following order:

said first non-frictionally enhanced region, said first frictionally enhanced region, said second non-frictionally enhanced region, said second frictionally enhanced region, and said third non-frictionally enhanced region.

8. The strap according to claim 7, wherein:

said first and second frictionally enhanced regions each contain six warp threads;

said first and third non-frictionally enhanced regions each contain three warp threads; and said second non-frictionally enhanced region contains sixteen warp threads.

9. The strap according to claim 7, wherein:

said first and second frictionally enhanced regions each contain eight warp threads;

said first and third non-frictionally enhanced regions each contain four warp threads; and said second non-frictionally enhanced region contains twenty warp threads.

10. A strap, comprising:

a frictionally enhanced layer comprising a plain weave woven from a plurality of upper warp threads and a first plurality of weft threads, said upper warp threads comprising frictionally enhanced threads and non-frictionally enhanced thread;

a non-frictionally enhanced layer comprising a plain weave woven from a plurality lower warp threads and a second plurality of weft threads, said lower warp threads comprising non-frictionally enhanced threads; and a connection between said frictionally enhanced layer and said non-frictionally enhanced layer comprising a plurality of internal elastomeric warp threads and a plurality of binder warp threads both woven over and under each of a complete set of weft threads, wherein every other warp thread of said connection belongs to said plurality of internally located elastomeric warp threads, and wherein said plurality of internal elastomeric threads are located substantially between said frictionally enhanced layer and said non-frictionally enhanced layer, and wherein said complete set of weft threads comprises said first plurality of weft threads and said second plurality of weft threads, wherein every other weft thread belongs to said first plurality of weft threads;

wherein said upper warp threads are arranged in frictionally enhanced regions and non-frictionally enhanced regions, said frictionally enhanced regions comprising a plurality of said frictionally enhanced upper warp threads, said non-frictionally enhanced regions comprising of plurality of said non-frictionally enhanced threads, wherein said frictionally and non-frictionally enhanced regions are alternatingly disposed across a width of said frictionally enhanced layer;

wherein said strap may be stretched from a non-elongated state to an elongated state, and wherein in both said non-elongated state and said elongated state at least a portion of said plurality of frictionally enhanced upper warp threads remain:

i.) visible on a surface of said strap;

ii.) substantially coplanar with said surface; and iii.) operable to provide friction enhancement along said surface.

11. The strap according to claim 10, wherein said disposition of said frictionally enhanced and non-frictionally enhanced regions are in the following order:

a first non-frictionally enhanced region, a first frictionally enhanced region, a second non-frictionally enhanced region, a second frictionally enhanced region, and a third non-frictionally enhanced region.

12. The strap according to claim 10, wherein said frictionally enhanced threads comprise an elastomeric material and said non-frictionally enhanced threads comprise at least one of polypropylene and nylon.

* * * * *